US007533549B2

(12) United States Patent
Günther

(10) Patent No.: US 7,533,549 B2
(45) Date of Patent: May 19, 2009

(54) PADLOCK HAVING A LAMELLAE-TYPE PREASSEMBLY LOCK BODY AND AN END LAMELLA SECURED THERETO

(75) Inventor: Raymond Günther, Wuppertal (DE)

(73) Assignee: ABUS August Bremicker Sochne KG, Wetter-Volmarstein (DE)

( * ) Notice: Subject to any disclaimer, the term of this patent is extended or adjusted under 35 U.S.C. 154(b) by 0 days.

(21) Appl. No.: 11/773,174

(22) Filed: Jul. 3, 2007

(65) Prior Publication Data

US 2009/0007606 A1 Jan. 8, 2009

(51) Int. Cl.
*E05B 67/02* (2006.01)

(52) U.S. Cl. ..... 70/52; 70/38 B; 70/38 A

(58) Field of Classification Search ..... 70/51, 70/52, 38 R–48
See application file for complete search history.

(56) References Cited

U.S. PATENT DOCUMENTS

| | | | | | |
|---|---|---|---|---|---|
| 1,718,606 | A * | 6/1929 | Soref | 70/38 C |
| 2,159,291 | A * | 5/1939 | Quintal | 70/21 |
| 2,379,437 | A * | 7/1945 | Hines et al. | 70/38 A |
| 2,726,531 | A * | 12/1955 | Vile | 70/38 B |
| 2,893,232 | A * | 7/1959 | Foote et al. | 70/38 B |
| 3,422,644 | A * | 1/1969 | Foote | 70/38 B |
| 3,546,906 | A * | 12/1970 | Yang | 70/21 |
| 3,783,657 | A * | 1/1974 | Foote | 70/52 |
| 3,835,676 | A * | 9/1974 | Foote | 70/52 |
| 3,952,560 | A * | 4/1976 | Lee | 70/52 |
| 3,979,931 | A * | 9/1976 | Man | 70/38 A |
| 4,290,279 | A * | 9/1981 | Fish et al. | 70/38 A |
| 4,899,560 | A * | 2/1990 | Chen | 70/52 |
| 5,697,239 | A | 12/1997 | Hanneman et al. | |
| 5,735,153 | A | 4/1998 | Hanneman et al. | |
| 5,794,925 | A | 8/1998 | Fantl et al. | |
| 5,839,309 | A | 11/1998 | Fantl et al. | |
| 6,705,134 | B2 * | 3/2004 | Miranda | 70/52 |
| 6,766,673 | B2 * | 7/2004 | Gast et al. | 70/38 A |
| 2007/0107476 | A1 * | 5/2007 | Ruan | 70/38 A |
| 2007/0234766 | A1 * | 10/2007 | Rohde et al. | 70/52 |

OTHER PUBLICATIONS

Master Lock catalogue 2003, pp. 86-87.

* cited by examiner

*Primary Examiner*—Suzanne D Barrett
(74) *Attorney, Agent, or Firm*—Gifford, Krass, Sprinkle, Anderson & Citkowski, P.C.

(57) ABSTRACT

A padlock includes a preassembly lock body including a plurality of lamellae that are bound together by at least one preassembly rivet and that define a cylinder recess. At least one end lamella is attachable to the preassembly lock body and at least partially covers the cylinder recess. A rivet extends through the at least one end lamella and extends at least partially through the preassembly lock body to secure the at least one end lamella to the preassembly lock body.

20 Claims, 4 Drawing Sheets

PADLOCK HAVING A LAMELLAE-TYPE PREASSEMBLY LOCK BODY AND AN END LAMELLA SECURED THERETO

FIELD

The present disclosure relates to padlocks.

BACKGROUND

The statements in this section merely provide background information related to the present disclosure and may not constitute prior art.

Padlocks typically include a lock body and a lockable shackle that is used to secure the padlock to a structure. Common structures include, but are not limited to, sheds, trunks, lockers and lock boxes. Such padlocks may be of the type having a lock body, which is formed by a plurality of lamellae bound together by rivets. Padlocks of this kind are advantageously inexpensive in production.

One type of padlock is a padlock having a key locking mechanism. This type of padlock includes advantages over other types of padlocks, a combination padlock, for example, because padlocks having a key locking mechanism do not require memorization of a combination. Instead, a key is used to unlock the padlock.

A particular kind of padlocks having a key locking mechanism is a so-called keyable padlock. Typically, keyable padlocks are shipped to a dealer (locksmith) in a semi-assembled state, having no locking mechanism or an unfinished locking mechanism. The semi-assembled padlocks are then keyed by the locksmith, i.e. the locksmith adds a locking mechanism or adapts the unfinished locking mechanism to a certain key or a certain key code in accordance with a customer's demand. For example, the end user often demands that the padlock be keyed in accordance with a certain key or a certain key code, as in the case of a re-order when the end user desires that the padlock can be opened by an existing key which also fits to other locks of this end user. Of course, the padlock could be keyed by the manufacturer in accordance with the end user's demands, but this expensive and time-consuming since small numbers of padlocks must be shipped to the individual locksmiths. Hence, it is desirable that the locksmith be enabled to key the padlock.

To this end, for example, a locking mechanism formed by a raw lock cylinder fixedly secured in the padlock can be adapted to a certain key by forcefully introducing this key into a core of the cylinder, e.g. using a hammer. Securing pins accommodated partly in an outer casing of the cylinder and partly in the core are sheared off thereby, so that the respective length of the securing pins is adapted to the specific key.

Such mechanical adaptation, however, is not very precise. The sheared off parts of the securing pins may cause undesirable friction between the core and the outer casing of the cylinder in subsequent use of the padlock. The life-time of the padlock is short.

It is also known to use an exchangeable lock cylinder, which is directly or indirectly secured to the lock body by means of a screw. This screw is accessible via a shackle passage provided in the lock body. The lock cylinder may therefore be exchanged as often as desired, and lock cylinders of high precision may be used. The exchangeable lock cylinder may be adapted to a certain key or a certain key code in accordance with a customer's demand by modifying the respective length of the individual securing pins of the lock cylinder. However, for many applications this arrangement is too expensive.

SUMMARY

Accordingly, the present disclosure provides a padlock that includes a preassembly lock body including a plurality of lamellae that are bound together by at least one preassembly rivet and that define a cylinder recess. At least one end lamella is attachable to the preassembly lock body and at least partially covers the cylinder recess. At least one rivet extends through the at least one end lamella and extends at least partially through the preassembly lock body to secure the at least one end lamella to the preassembly lock body.

In other features, the at least one end lamella includes at least one recess that accommodates an exposed end of the at least one preassembly rivet. The rivet extends through the at least one recess of the at least one end lamella.

In another feature, an end of the rivet at least partially covers an exposed end of the at least one preassembly rivet.

In still other features, the preassembly lock body includes a passage defined therein, wherein the rivet extends into the passage. The passage extends only partially through the preassembly lock body.

In another feature, at least one of said plurality of lamellae has a recess portion, wherein said at least one rivet engages said recess portion.

In yet another feature, the padlock further includes a lock cylinder that is located within the cylinder recess and that is retained therein by the at least one end lamella.

In another feature, said at least one end lamella has a front side and a rear side, wherein said at least one end lamella further includes at least two recesses, wherein said preassembly lock body includes at least two passages defined therein, wherein at least two rivets extend through a respective one of said at least two recesses into a respective one of said at least two passages, wherein said at least two recesses are arranged such that they are in alignment with said at least two passages only if the rear side of said at least one end lamella faces said preassembly lock body.

The padlock of the present disclosure enables a locksmith, for example, to be provided with a partially assembled padlock. The locksmith may select a lock cylinder from a selection of pre-keyed lock cylinders or adapt a standard lock cylinder to a specific key by providing this standard lock cylinder with securing pins of corresponding length. In this manner, the locksmith may adapt the partially assembled padlock to a certain key or a certain key code, wherein the particular type of lock cylinder and key or key code can be selected based on the specific type of key an end customer desires. The locksmith inserts the selected or adapted lock cylinder into the preassembly lock body and completes the assembly of the padlock by securing the end lamella thereto. To this end, a common riveting process may be carried out by the locksmith or even by the end user in an easy and time-efficient manner. Since the preassembly lock body is formed by a plurality of lamellae that are bound together, provision may easily be made for allowing a rivet or several rivets to secure the end lamella to the preassembly lock body. A common riveting tool can be used.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 3:
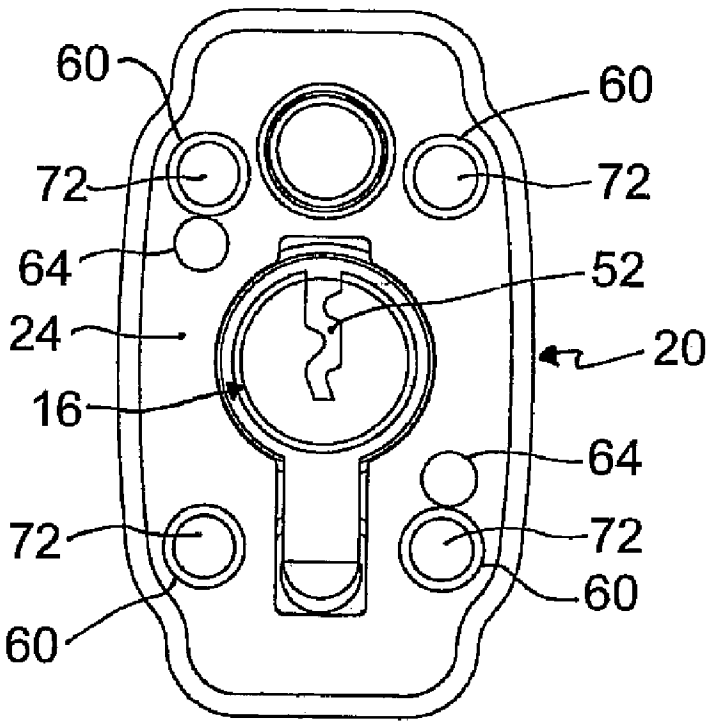
FIG. 3 is a plan view of a bottom of the padlock in a partially assembled state without an end lamella assembled thereto.

The following description is merely exemplary in nature and is not intended to limit the present disclosure, application, or uses. It should be understood that throughout the drawings, corresponding reference numerals indicate like or corresponding parts and features.

Figure 1:
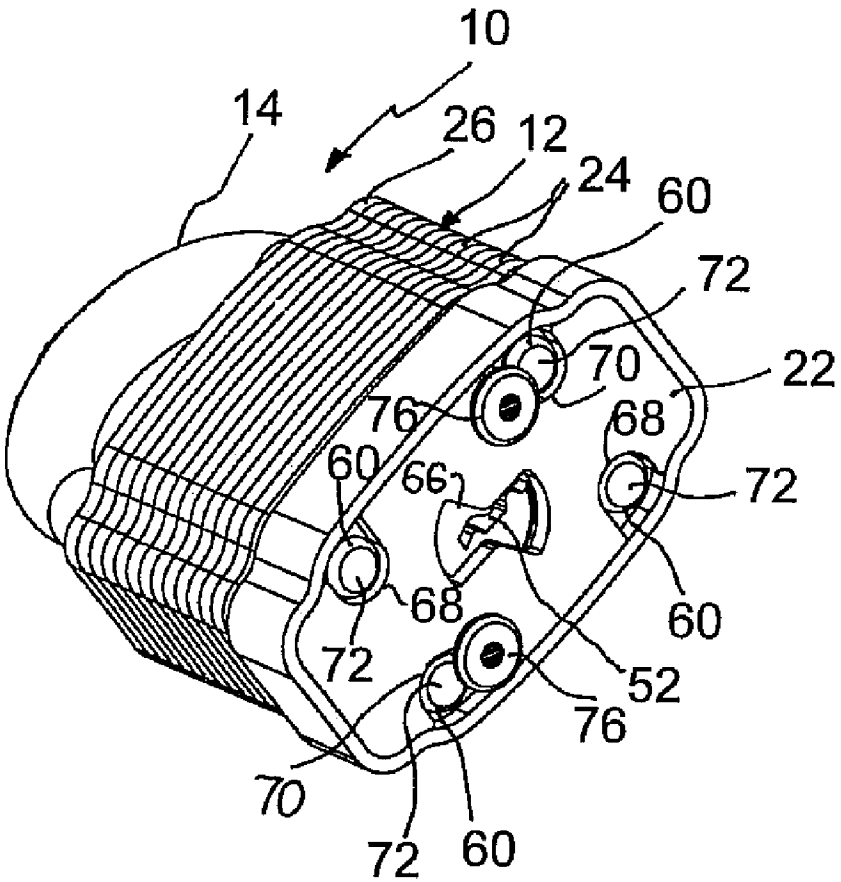
FIG. 1 is a perspective view of a padlock in accordance with the present disclosure.
Figure 2:
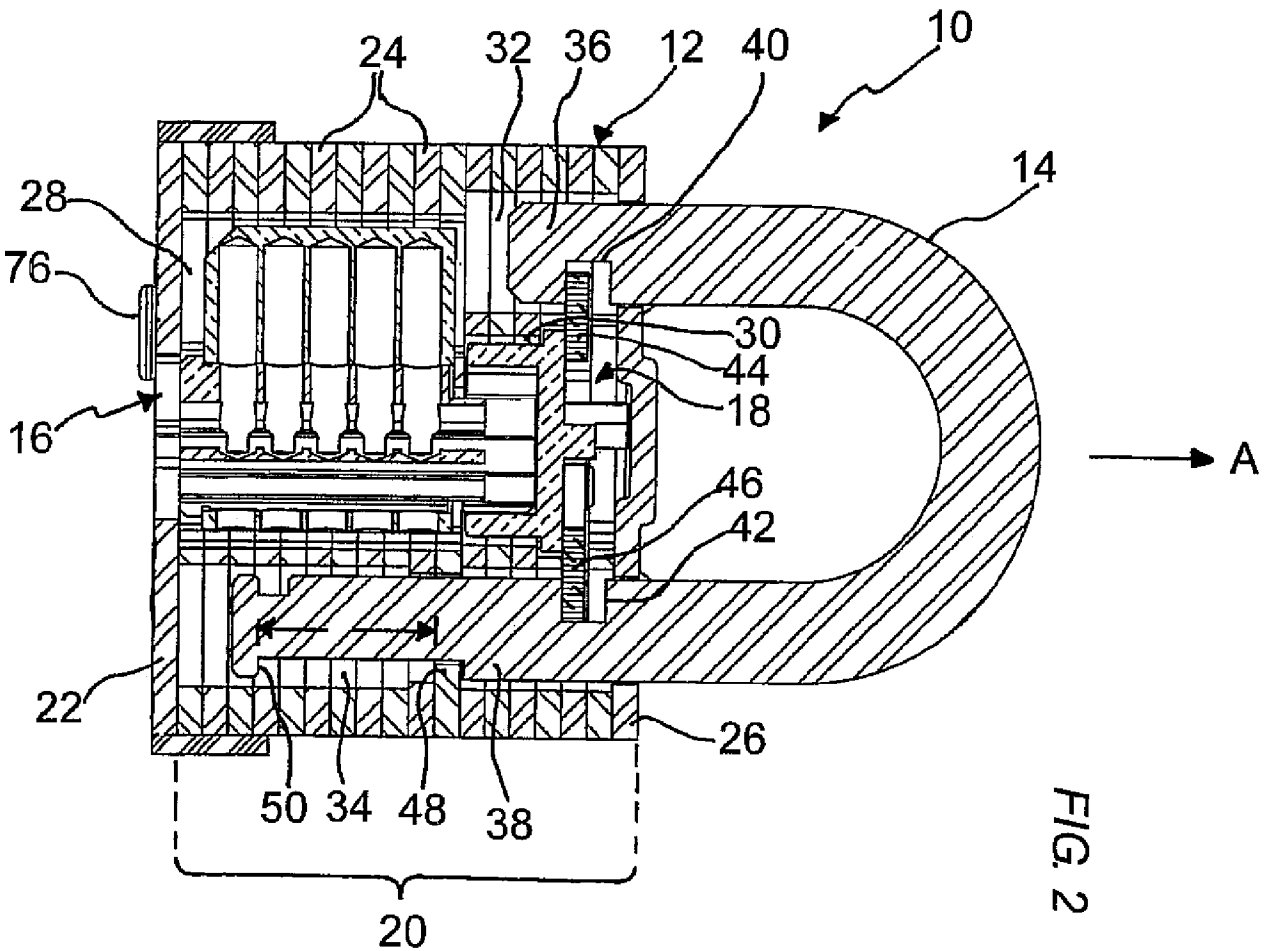
FIG. 2 is a cross-sectional view through the center of the padlock.

Referring now to FIGS. 1 and 2, a padlock 10 is illustrated and includes a lock body 12, a U-shaped shackle 14, as well as a lock cylinder 16 and a lock actuator 18 that are secured within the lock body 12. The lock body includes a preassembly lock body 20 and an end lamella 22. The preassembly lock body 20 includes a plurality of lamellae 24 and a top lamella 26. The lamellae 22, 24, 26 are metal plates which typically are formed by a punching or stamping process. The plurality of lamellae 24 of the preassembly lock body 20 defines a cylinder recess 28 and an actuator recess 30, within which the lock cylinder 16 and lock actuator 18 are respectively located.

The plurality of lamellae 24 of the preassembly lock body 20 further define first and second passages 32, 34, within which respective first and second legs 36, 38 of the shackle 14 are slidably disposed. The first and second legs 36, 38 include respective notches 40, 42, which are selectively engaged by respective locking members 44, 46 of the lock actuator 18 to inhibit axial movement of the shackle 14 in the direction A. The first leg 36 is shorter than the second leg 38 and may be withdrawn from the first passage 32. The second leg 38 is slidably disposed within the second passage 34 but can not be withdrawn therefrom. More specifically, a blocking member 48 of one of the plurality of lamellae 24 extends into a blocking notch 50 defined within the second leg 38. The blocking notch 50 defines the range of slidable movement of the second leg 38 within the second passage 34 and the blocking member 48 inhibits removal of the second leg 38 from the second passage 34.

The lock cylinder 16 is operably engaged with the lock actuator 18. A key (not shown) is insertable into a keyhole 52 of the lock cylinder 16 to enable rotation of a core of the lock cylinder 16 between a first position and a second position. In the first position, which is shown in FIG. 2, the lock cylinder 16 holds the lock actuator 18 in a locked condition. In the locked condition, the locking members 44, 46 of the lock actuator 18 engage the notches 40, 42 of the first and second legs 36, 38 of the shackle 14, thereby inhibiting axial movement of the shackle 14 in the direction A. In the second position, the lock cylinder 16 holds the lock actuator 18 in an unlocked condition. In the unlocked condition, the locking members 44, 46 of the lock actuator 18 retreat from the notches 40, 42 of the first and second legs 36, 38, enabling the shackle 14 to move in the direction A by a distance X defined by the blocking member 48 and the blocking notch 50 of the second leg 38.

Referring now to FIGS. 3-6, the top lamella 26 and the plurality of lamellae 24 are secured adjacent to one another via four rivets 60 that extend through first passages 62 defined in the lamellae (see FIGS. 2, 3 and 6) to define the preassembly lock body 20. The plurality of lamellae 24 also define two second passages 64 for securing the end lamella 22 to the preassembly lock body 20, as discussed in further detail below.

Figure 4:
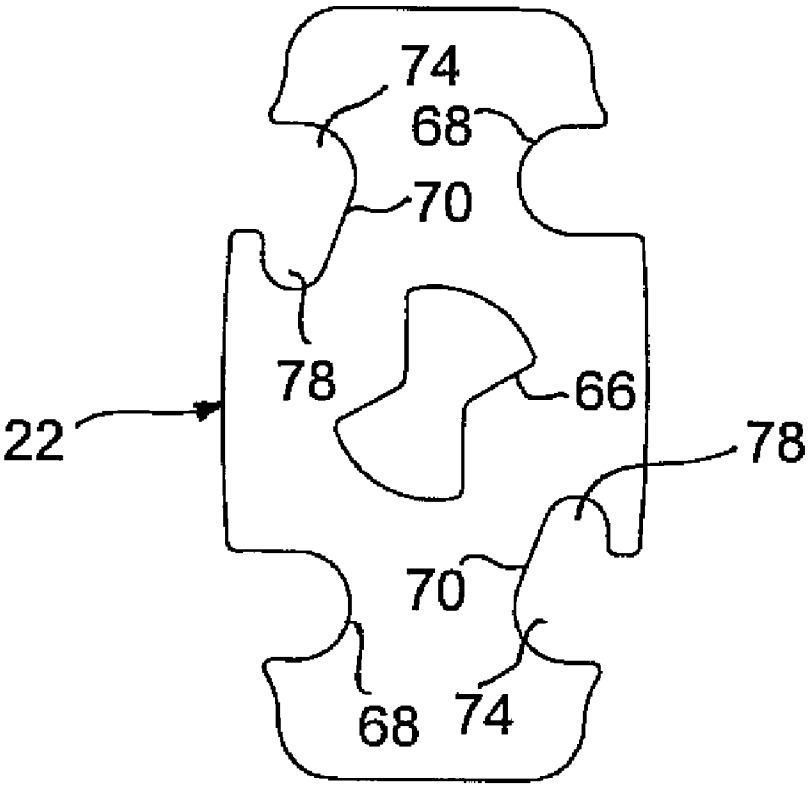
FIG. 4 is a plan view showing a front side of the end lamella of the padlock.

With particular reference to FIG. 4, the end lamella 22 includes a central key passage 66, two recesses 68 which are disposed diagonally opposed to one another with respect to the central key passage 66, and two elongated recesses 70 which are also disposed diagonally opposed to one another with respect to the central key passage 66. The recesses 68 and elongated recesses 70 accommodate the ends of the rivets 60 that hold the preassembly lock body 20 together. More specifically, when the end lamella 22 is stacked adjacent to the preassembly lock body 20, heads 72 of the rivets 60 seat within the recesses 68 and within arcuate portions 74 of the elongated recesses 70, respectively (see FIGS. 1, 4 and 6). Two secondary rivets 76 extend through auxiliary portions 78 of the elongated recesses 70 and into the second passages 64 of the preassembly lock body 20. The secondary rivets 76 secure the end lamella 22 to the preassembly lock body 20 and partially cover the heads 72 of the respective rivets 60, thereby protecting the heads 72 of the respective rivets 60. The end lamella 22 sufficiently covers a portion of the cylinder recess 28 to prevent removal of the lock cylinder 16.

Figure 6:
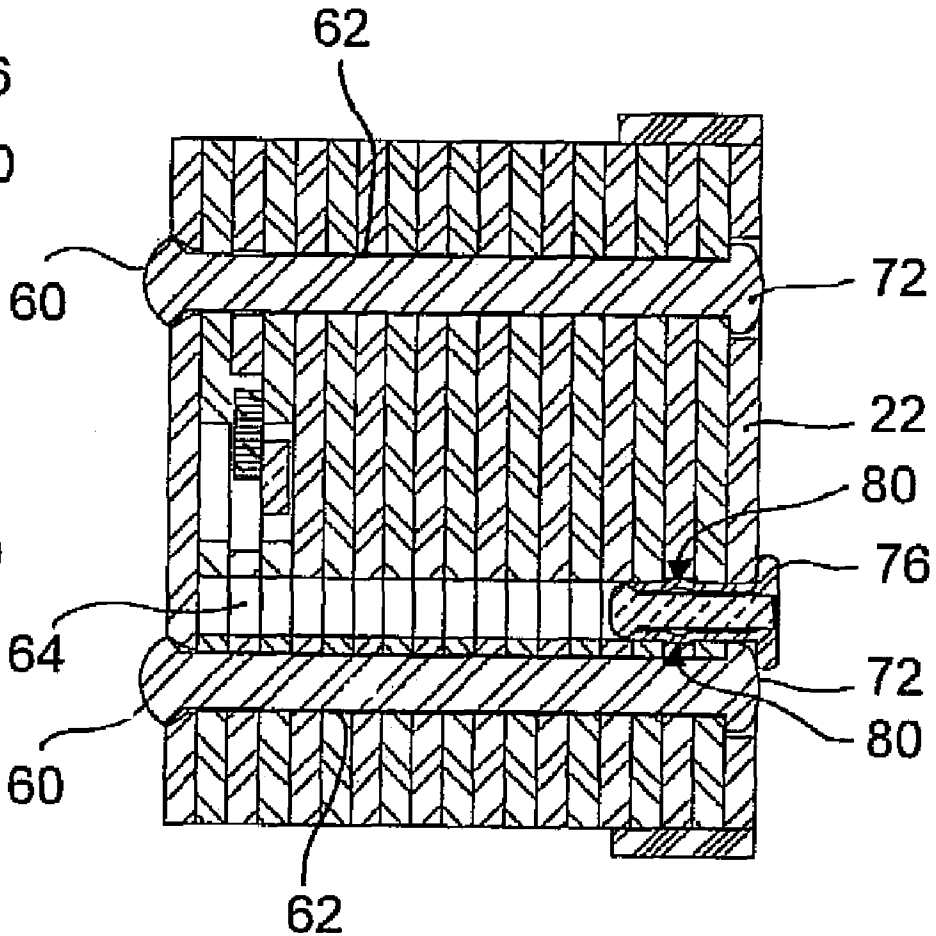
FIG. 6 is a cross-sectional view of the padlock along line 6-6 of FIG. 5.
Figure 5:
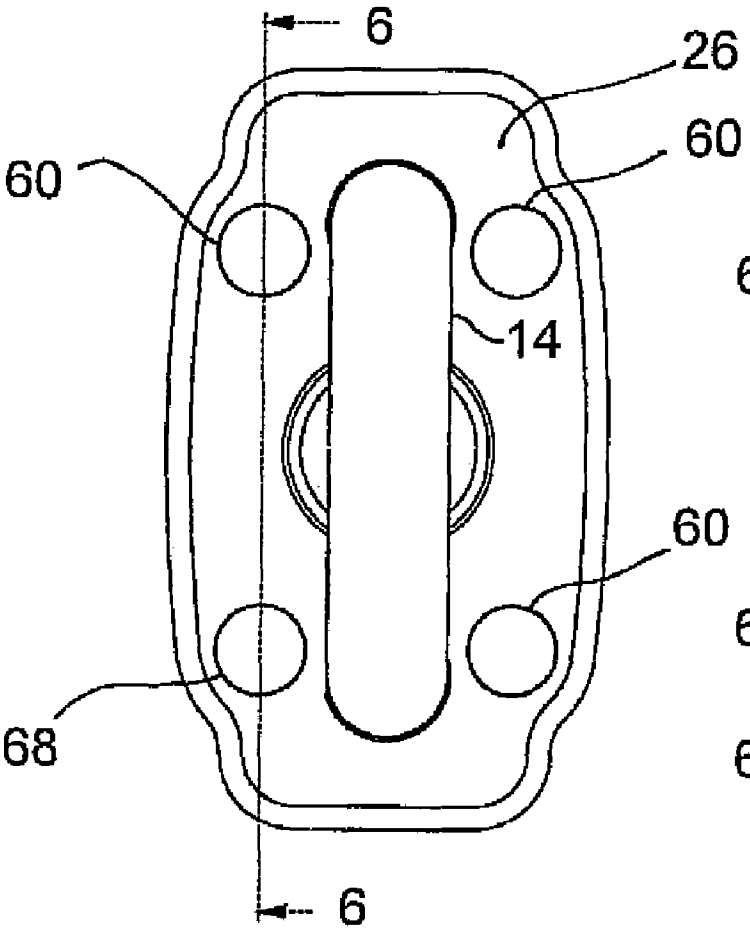
FIG. 5 is a top view of the padlock.

Recess portions 80 at least one of the plurality of lamellae 24 within the preassembly lock body 20 allow the secondary rivets 76 to be reliably secured to the preassembly lock body 20, wherein the respective secondary rivet 76 engages the associated recess portion 80 (see FIG. 6). The secondary rivets 76 extend only through a part of the preassembly lock body 20, and at the top side of the lock body 12 the second passages 64 are closed by the top lamella 26. Therefore, the secondary rivets 76 are not accessible from the top side of the lock body 12. Also, comparatively short rivets with respect to the length of the lock body 12 may be used as secondary rivets 76, which allows a common riveting process and common riveting tools to be used for securing the end lamella 22 to the preassembly lock body 20.

The padlock 10 of the present disclosure can be provided to a customer or locksmith in a partially assembled condition for final assembly by the customer or locksmith. More specifically, a preassembly including the preassembly lock body 20 with the shackle 14 and the lock actuator 18 assembled therein can be provided to the customer or locksmith along with an end lamella 22 and secondary rivets 76. The customer or locksmith can select a specific lock cylinder 16 from a selection of lock cylinders 16, or he can adapt an unfinished lock cylinder to a certain key or a certain key code. Final assembly of the padlock 10 is achieved by the customer or locksmith by assembling the selected lock cylinder 16 into the cylinder recess 28 and securing the end lamella 22 to the preassembly lock body 20 by means of the secondary rivets 76, thereby securing the lock cylinder 16 within the cylinder recess 28. A common riveting tool may be used for securing the end lamella 22 to the preassembly lock body 20.

As can be discerned from the respective front side view of the end lamella 22 according to FIGS. 1 and 4, the central key passage 66 formed in the end lamella 22 allows for a rotation of a key inserted into the keyhole 52 by about 60°. The key passage 66 is symmetrical with respect to a rotation of the end lamella 22 by 180°, but it is asymmetrical with respect to the front side and the rear side of the end lamella 22. An upside-down arrangement of the end lamella 22 at the preassembly lock body 20 would block a key inserted into the keyhole 52 against rotation in the correct direction. Advantageously, since the elongated recesses 70 of the end lamella 22 are diagonally opposing each other with respect to the key passage 66, the elongated recesses 70 are also asymmetrical with respect to an upside-down arrangement of the end lamella 22. This asymmetric arrangement of the elongated recesses 70 therefore effectively prevents the user from inadvertently securing the end lamella 22 to the preassembly lock body 20 with the front side (instead of the rear side) facing the preassembly lock body 20. Only in the correct arrangement of the end lamella 22 the auxiliary portions 78 of the elongated recesses 70 are in alignment with the second passages 64, thereby allowing the secondary rivets 76 to be introduced into the second passages 64.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A padlock, comprising:

a preassembly lock body including a plurality of lamellae that are bound together by at least one elongated preassembly rivet and that define a cylinder recess, said preassembly rivet having a rivet head at each end, said rivet head each overlying a portion of said lamellae at each end of said preassembled lock body to thereby bound said lamella together in said preassembly lock body;

at least one end lamella that is attachable to said preassembly lock body, and that at least partially covers said cylinder recess; and at least one final assembly rivet that extends through said at least one end lamella and that extends at least partially through said preassembly lock body to secure said at least one end lamella to said preassembly lock body;

wherein said at least one end lamella includes at least one recess that accommodates an exposed end of said at least one preassembly rivet.

2. The padlock of claim 1 wherein said at least one final assembly rivet extends through said at least one recess of said at least one end lamella.

3. The padlock of claim 1 wherein an end of said at least one rivet at least partially covers an exposed rivet head of said at least one preassembly rivet.

4. The padlock of claim 1 wherein said preassembly lock body includes at least one passage defined therein, wherein said at least one final assembly rivet extends into said at least one passage.

5. The padlock of claim 4 wherein said at least one passage extends only partially through said preassembly lock body.

6. The padlock of claim 1 wherein at least one of said plurality of lamellae has a recess portion, wherein said at least one final assembly rivet engages said recess portion.

7. The padlock of claim 1 further comprising a lock cylinder that is located within said cylinder recess and that is retained therein by said at least one end lamella.

8. The padlock of claim 1 wherein said at least one end lamella has a front side and a rear side, wherein said at least one end lamella further includes at least two recesses, wherein said preassembly lock body includes at least two passages defined therein, wherein at least two final assembly rivets extend through a respective one of said at least two recesses into a respective one of said at least two passages, wherein said at least two recesses are arranged such flat they are in alignment with said at least two passages only if the rear side of said at least one end lamella faces said preassembly lock body.

9. A method of assembling a padlock, comprising:

binding a plurality of lamellae together by at least one preassembly rivet to form a preassembly lock body that defines a cylinder recess;

thereafter at least partially covering said cylinder recess with at least one end lamella;

securing said at least one end lamella to said preassembly lock body using at least one final assembly rivet that extends through said at least one end lamella and that extends at least partially through said preassembly lock body; and providing said at least one end lamella with at least one recess that accommodates an exposed end of said at least one preassembly rivet.

10. A method of assembling a padlock, comprising:

binding a plurality of lamellae together by at least one preassembly rivet to form a preassembly lock body that defines a cylinder recess;

thereafter at least partially covering said cylinder recess with at least one end lamella;

securing said at least one end lamella to said preassembly lock body using at least one final assembly rivet that extends through said at least one end lamella and that extends at least partially through said preassembly lock body;

providing said at least one end lamella with at least one recess that accommodates an exposed end of said at least one preassembly rivet; and at least partially covering an exposed end of said at least one preassembly rivet using an end of said at least one final assembly rivet.

11. The method of claim 10 wherein said at least one final assembly rivet extends through said at least one recess of said at least one end lamella.

12. The method of claim 10 wherein said preassembly lock body includes a passage defined therein, wherein said at least one final assembly rivet extends into said passage.

13. The method of claim 12 wherein said passage extends only partially through said preassembly lock body.

14. The method of claim 10 further comprising retaining a lock cylinder within said cylinder recess using said at least one end lamella.

15. A padlock, comprising:

a preassembly lock body including a plurality of lamellae that are bound together by at least one preassembly rivet, said preassembly rivet having a rivet head at each end, said rivet head each overlying a portion of said lamellae at each end of said preassembled lock body to thereby bound said lamella together in said preassembly lock body; and at least one end lamella that is attachable to said preassembly lock body and that includes at least one final assembly recess;

wherein said preassembly lock body includes at least one passage, and wherein said at least one passage and said at least one recess are adapted to receive at least one rivet that extends through said at least one final assembly recess and said at least one passage for securing said at least one end lamella to said preassembly lock body;

wherein said at least one final assembly recess is adapted to accommodate an exposed end of said preassembly rivet.

16. The padlock of claim 15 wherein said at least one end lamella is adapted to at least partially cover a cylinder recess of said preassembly lock body and retain a lock cylinder therein.

17. A padlock, comprising:

a preassembly lock body including a plurality of lamellae that are bound together by at least one elongated preassembly rivet and that define a cylinder recess, said preassembly rivet having a rivet head at each end, said rivet head each overlying a portion of said lamellae at each end of said preassembled lock body to thereby bound said lamella together in said preassembly lock body;

at least one end lamella that is attachable to said preassembly lock body, and that at least partially covers said cylinder recess; and at least one final assembly rivet that extends through said at least one end lamella and that extends at least partially Through said preassembly lock body to secure said at least one end lamella to said preassembly lock body;

wherein an end of said at least one final assembly rivet at least partially covers an exposed rivet head of said at least one preassembly rivet.

18. A padlock, comprising:

a preassembly lock body including a plurality of lamellae that are bound together by at least one elongated preassembly rivet and that define a cylinder recess, said preassembly rivet having a rivet head at each end, said rivet head each overlying a portion of said lamellae at each end of said preassembled lock body to thereby bound said lamella together in said preassembly lock body;

at least one end lamella that is attachable to said preassembly lock body, and that at least partially covers said cylinder recess; and at least one final assembly rivet that extends through said at least one end lamella and that extends at least partially through said preassembly lock body to secure said at least one end lamella to said preassembly lock body;

wherein at least one of said plurality of lamellae has a recess portion, wherein said at least one final assembly rivet engages said recess portion.

19. A padlock, comprising:

a preassembly lock body including a plurality of lamellae that are bound together by at least one elongated preassembly rivet and that define a cylinder recess, said preassembly rivet having a rivet head at each end, said rivet head each overlying a portion of said lamellae at each end of said preassembled lock body to thereby bound said lamella together in said preassembly lock body;

at least one end lamella that is attachable to said preassembly lock body, and that at least partially covers said cylinder recess; and at least one final assembly rivet that extends through said at least one end lamella and that extends at least partially through said preassembly lock body to secure said at least one end lamella to said preassembly lock body;

wherein said at least one end lamella has a front side and a rear side, wherein said at least one end lamella further includes at least two recesses, wherein said preassembly lock body includes at least two passages defined therein, wherein at least two final assembly rivets extend through a respective one of said at least two recesses into a respective one of said at least two passages, wherein said at least two recesses are arranged such that they are in alignment with said at least two passages only if the rear side of said at least one end lamella faces said preassembly lock body.

20. A method of assembling a padlock, comprising:

binding a plurality of lamellae together by at least one preassembly rivet to form a preassembly lock body that defines a cylinder recess;

thereafter at least partially covering said cylinder recess with at least one end lamella;

securing said at least one end lamella to said preassembly lock body using at least one final assembly rivet that extends through said at least one end lamella and that extends at least partially through said preassembly lock body; and providing said at least one end lamella with at least one recess that accommodates an exposed end of said at least one preassembly rivet, wherein at least one of said plurality of lamellae has a recess portion, wherein said at least one final assembly rivet engages said recess portion.

* * * * *